US010872530B2

(12) United States Patent
Budde

(10) Patent No.: US 10,872,530 B2
(45) Date of Patent: Dec. 22, 2020

(54) DISPLAY FOR GIVING VISUAL WARNINGS ABOUT CYCLISTS WHEN TURNING OFF A MAIN ROAD INTO A SIDE ROAD

(71) Applicant: Martin Budde, Hamburg (DE)

(72) Inventor: Martin Budde, Hamburg (DE)

( * ) Notice: Subject to any disclaimer, the term of this patent is extended or adjusted under 35 U.S.C. 154(b) by 0 days.

(21) Appl. No.: 16/646,749

(22) PCT Filed: Aug. 7, 2018

(86) PCT No.: PCT/DE2018/100696
§ 371 (c)(1),
(2) Date: Mar. 12, 2020

(87) PCT Pub. No.: WO2019/052595
PCT Pub. Date: Mar. 21, 2019

(65) Prior Publication Data

US 2020/0279486 A1 Sep. 3, 2020

(30) Foreign Application Priority Data

Sep. 12, 2017 (DE) ..... 10 2017 121 029

(51) Int. Cl.
*G08G 1/16* (2006.01)
*G08G 1/095* (2006.01)

(52) U.S. Cl.
CPC ..... *G08G 1/164* (2013.01); *G08G 1/095* (2013.01); *G08G 1/166* (2013.01)

(58) Field of Classification Search
CPC ..... G08G 1/164; G08G 1/095; G08G 1/166
See application file for complete search history.

(56) References Cited

U.S. PATENT DOCUMENTS

| | | | | |
|---|---|---|---|---|
| 2003/0191577 | A1 | 10/2003 | Decaux | |
| 2005/0270175 | A1* | 12/2005 | Peddie | E01F 9/559 340/907 |
| 2010/0100324 | A1 | 4/2010 | Caminiti et al. | |
| 2013/0253816 | A1* | 9/2013 | Caminiti | G08G 1/005 701/301 |
| 2014/0307087 | A1 | 10/2014 | Evanitsky et al. | |

FOREIGN PATENT DOCUMENTS

| | | |
|---|---|---|
| CN | 206322325 | 7/2017 |
| DE | 102015225410 | 12/2015 |
| WO | 2011/044868 | 8/2010 |

* cited by examiner

*Primary Examiner* — Sisay Yacob
(74) *Attorney, Agent, or Firm* — Diederiks & Whitelaw, PLC.

(57) ABSTRACT

A Display device gives a visual warning to a car driver who is turning off a main road into a side road about a person who is approaching the side road parallel to the main road, the display device includes at least one sensor for sensing the person and at least one light which emits a visual warning signal when a person approaches, wherein the emission angle of the light which emits the visual warning signal is oriented so as to open into the intersection region between a first axis running transversely with respect to the course of the main road and a second axis running transversely with respect to the course of the side road.

19 Claims, 5 Drawing Sheets

DISPLAY FOR GIVING VISUAL WARNINGS ABOUT CYCLISTS WHEN TURNING OFF A MAIN ROAD INTO A SIDE ROAD

CROSS-REFERENCE TO RELATED APPLICATIONS

This application represents the U.S. National Phase of International Application number PCT/DE2018/100696 entitled "Display Device for Giving Visual Warnings About Cyclists when Turning off a Main Road into a Side Road" filed Aug. 7, 2018, which claims benefit to German Patent Application number 10 2017 121 029.6 filed Sep. 12, 2017, all of which are incorporated herein by reference.

BACKGROUND OF THE INVENTION

The invention relates to a display device for giving a visual warning to a car driver who is turning off a main road into a side road about a person who is approaching the side road parallel to the main road, with at least one sensor for sensing the person and at least one light which emits a visual warning signal when a person approaches.

FIG. 1 shows such a typical traffic situation when turning at an intersection from a main road into a side road in a schematic top view. In particular, FIG. 1 shows a main road HS with a side road NS running at a right angle to the main road HS, forming an intersection. For the purpose of this description, the terms "main road" and "side road" serve only to distinguish the roads, but do not necessarily mean that one road takes precedence over the other.

In order to regulate the traffic flow, several traffic light systems LSA are installed at the intersection of the main road HS and the side road NS, which enable a safe branching off from the main road HS into the side road and/or from the side road NS into the main road.

Furthermore, two cars or drivers A1, A2 are shown, which are on the main road HS, whereby one driver A1 is about to turn from the main road HS into the side road NS.

The turning of car driver A2 is dangerous in that parallel to the main road HS there is a cycle path RW which crosses the side road NS and is used by the cyclists R1, R2, R3.

While the driver A1 can observe the cyclists R2 and R3 in front of him in the direction of travel during the turn and take them into account by adapting his driving style to their movements, the cyclist R1, who is behind the driver A1 in the opposite direction to his direction of travel, moves outside his normal field of vision and therefore remains unnoticed during the turn. Even with a shoulder view swiveling against the direction of travel, a cyclist R1 moving quickly in the direction of travel may not be perceived, so that a collision between driver A1 and cyclist R1 may occur.

In order to avoid this dangerous situation as far as possible and to prevent corresponding accidents, a light signal system is already known from EP 2 462 574 B1, which is equipped with a sensor directed against the direction of travel of the traffic to be regulated, which recognizes a person approaching the light signal system to the right of a vehicle as seen in the direction of travel and, responding to this, causes the lighting up or flashing of a fourth signal light arranged adjacent to the green signal light.

Although this idea is in principle suitable for avoiding the above-mentioned accidents, practical tests have shown that although the traffic lights are still perceived when approaching the intersection from a distance, when the traffic light is green they are no longer noticed when approaching further, and in the meantime, persons approaching the traffic lights and entering this danger zone are not much better protected.

SUMMARY OF THE INVENTION

The object of the invention is therefore to create a display device for the protection of a person about to cross a road or a path in the area of an intersection which can be better perceived by the driver.

According to the invention, this object is solved by the display device with the features of claim 1. The subclaims reflect advantageous embodiments of the invention.

The basic idea of the invention is to provide a display device and to position it in such a way that it can be seen by the driver during the turning process. According to the invention, the display device for the turning driver is aligned in such a way that he can see the light signal emitted by the display device during the turning operation itself, i.e. when turning from the main road into the side road.

For this purpose, the display device is arranged in the direction of travel of a driver driving on the main road in the intersection region with the side road in front of the secondary road, i.e. on the inside of the curve to be described by the driver, and is set up in such a way that the emission angle of the display device in the intersection region lies in a range between a first axis running transversely to the course of the main road and a second axis running transversely to the course of the side road. The display device is thus always located to the right of the driver during the turning process in the case of right-hand traffic (and to the left of the driver in the case of left-hand traffic) and runs from the inside of the bend substantially transversely to the direction of travel of the turning vehicle. In particular, the display device runs into an area behind a traffic light set up in front of the junction, which can be detected by the turning driver.

On the other hand, a driver who is on the main road and does not want to turn into the side road will not notice the display device, as his view is directed towards the course of the main road, into which the display device substantially also emits.

If, according to the prior art, it was previously not possible to warn the turning driver of an approaching person when he has passed the traffic light system set up in front of the junction, the display device according to the invention now appears directly in the driver's field of vision when he looks over his shoulder, so that a warning is easily perceived. Since, according to the invention, a person moving in the driver's "blind spot" is indicated by the display device visible to the driver at all times during the turning operation, the risk of an accident when turning is considerably reduced.

The arrangement of the display device is chosen in such a way that the display device, according to the invention, is located on the inside of the curve, so that the driver does not have to pay attention to light signals or displays (e.g. on the opposite side of the road) which distract from the actual source of danger.

The display device according to the invention is especially operable and usable independently of a light signal system. For example, a display device designed according to the invention can also be set up at intersections where no traffic lights are installed, so that even at intersections without traffic lights, the safety of crossing persons, especially cyclists, is increased from turning traffic. In addition, a display device set up according to the invention, which can be specifically operated as a stand-alone system, provides for increased safety when crossing the road in case a pre-installed traffic light fails and the traffic situation is unclear under certain circumstances without traffic control by appropriate traffic light systems.

According to the invention, a display device or an arrangement with a display device for visually warning a driver who turns off a main road into a side road of a person approaching the side road parallel to the main road (coming from the direction of travel of the driver on the main road), with at least one sensor for detecting the person and at least one light emitting a visual warning signal when a person approaches, the emission angle of which is oriented so as to open into the intersection region between a first axis running transversely to the course of the main road and a second axis running transversely to the course of the side road. The imaginary axes can, for example, be at right angles to the main road or side road.

The terms "main road" and "side road" are merely intended to make clear the distinction between two roads and/or paths for the purpose of the description. Thus, for example, a "side road" may also be a driveway or access road to a property crossed by a pedestrian or cycle path, the display device, according to the invention, being used at the intersection of the road ("main road") and driveway/access road ("side road").

Preferably, the emission angle of the light itself is limited by the first axis and the second axis. This ensures that the entire hazardous area, where the driver must look over his shoulder anyway, is illuminated in such a way that the driver perceives the warning signal emitted by the display.

It is further preferable for the display device to be at least partially designed as a railing accompanying the transition from the main road to the side road. The design of the display device as a railing has the advantage that on the one hand it prevents the driver from "cutting" the curve and on the other hand it provides protection for people behind the railing on the cycle path or pedestrian path. This is particularly advantageous at intersections frequently used by truck drivers.

The at least one light is specially arranged at the height of a car window, whereby the at least one light can also be arranged at the height of a truck window. However, two lights arranged at different heights are particularly preferred, so that both car drivers and truck drivers can perceive the visual warning signal.

The light located at the height of a car window is approximately between 0.90 m and 1.30 m from the road surface. The light located at the height of a truck window is approximately between 2.10 m and 2.70 m from the road surface.

According to another preferred embodiment, the at least one light is designed as a display. The display can be designed as a screen, for example. In particular, the display can be designed as a running light.

In particular, the at least one light is convex. This design also creates a railing with the advantages mentioned above.

The display device preferably has a lighting device which at least partially illuminates the quadrants diagonally opposite the intersection region. With the help of this design, a person approaching the intersection region is better perceived in darkness.

Further preferably, the display device will have a sign or display on the (inner) side opposite its outer side, i.e. facing the cycle path, which will inform the person approaching the side road of the dangerous situation.

In addition, a photovoltaic system is provided to supply the display device with energy, thus enabling the device to be controlled independently.

Finally, the display device is set up in such a way that the person to be sensed or the person sensed is a cyclist, especially a cyclist. In this case, the direction of movement in particular, but preferably also the speed or the change in speed of the person is sensed.

BRIEF DESCRIPTION OF THE DRAWINGS

The invention is explained in more detail in the following on the basis of particularly preferred exemplary embodiments, which are shown in the attached drawings. They show.

DETAILED DESCRIPTION OF THE PREFERRED EMBODIMENTS

Figure 2:
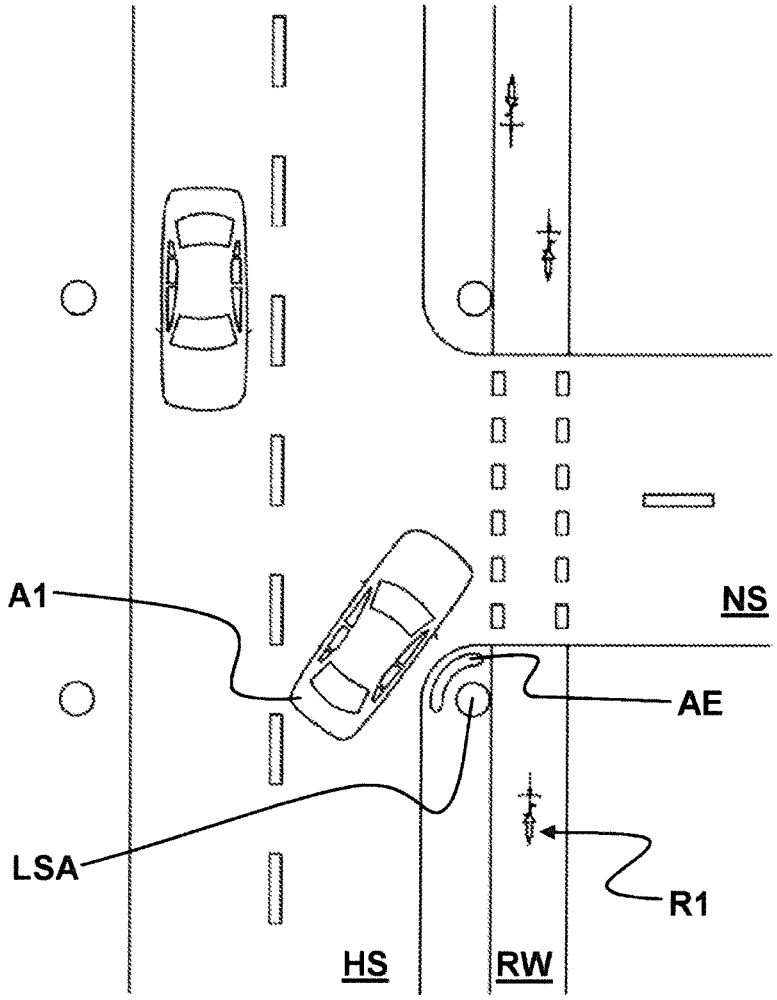
FIG. 2 a schematic top view of an intersection with a first exemplary embodiment according to the present invention.

FIG. 2 shows a schematic top view of an intersection with a first exemplary embodiment according to the present invention.

Figure 1:
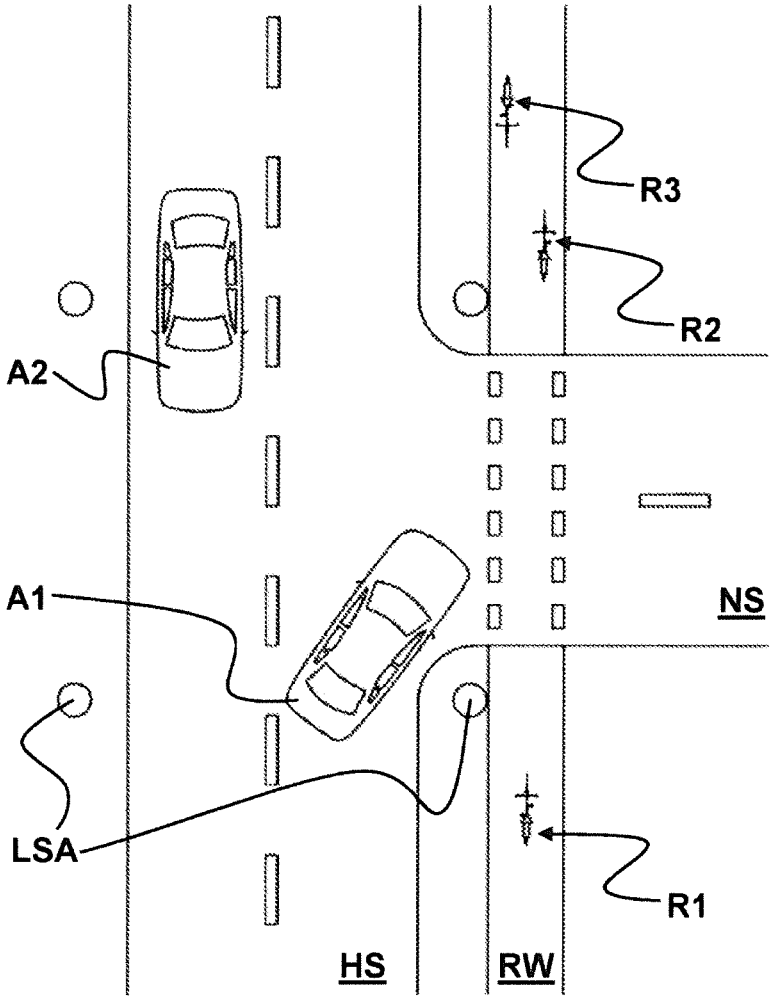
FIG. 1 a schematic top view of a traffic situation when turning at an intersection from a main road onto a side road.

FIG. 2 essentially shows the traffic situation already described for FIG. 1 with the difference that the driver A1 is warned of the cyclist R1 by the particularly preferred display device AE.

The display device AE is designed in particular as a railing and has a concave light in the form of a display. The display device is located on the inside of the curve to be driven by the driver A1 during the turning operation, so that the display device AE is always in the field of vision of the driver turning when he looks over his shoulder.

The display device AE has a sensor for detecting the person R1, in this case a cyclist, and when the person R1 approaches as shown, the display device AE emits an optical warning signal directed at the car driver A1 turning from the main road HS into the side road NS.

Due to the convex design of the display of the display device, the emission angle of the light emitting the visual signal is oriented so as to open up into the intersection region between a first axis transverse to the course of the main road HS and a second axis transverse to the course of the side road NS.

Figure 3:
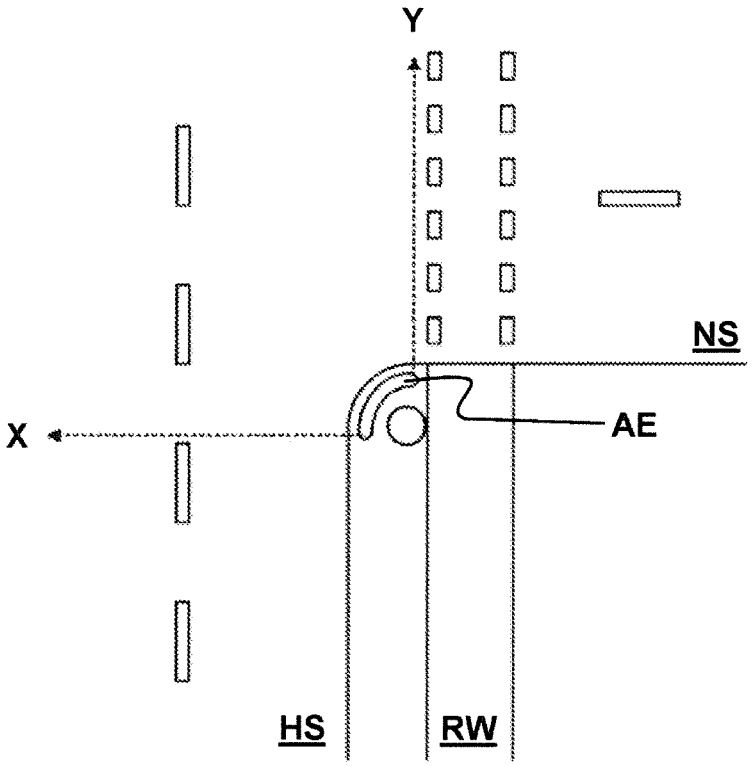
FIG. 3 a detailed view of the intersection from FIG. 1.

For clarification, FIG. 3 shows a detailed view of the intersection shown in FIG. 2. The first axis X, which runs transversely to the main road HS and the second axis Y, which runs transversely to the side road NS, limit the emission angle, which means that the driver must be at a right angle to the display device AE to be able to see the warning signal.

Figure 4:
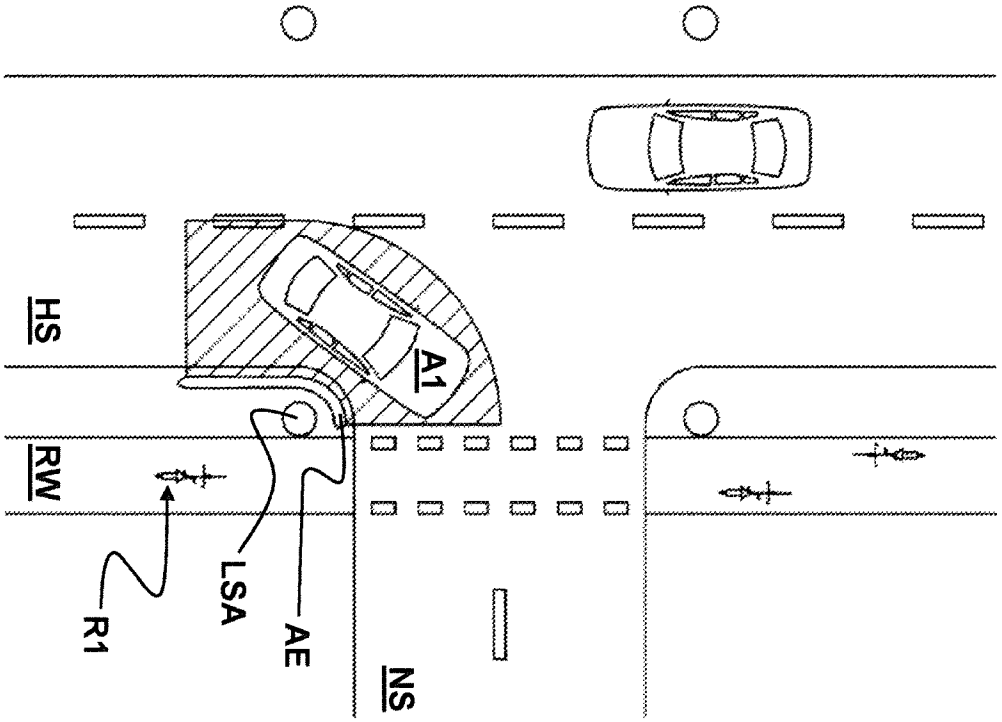
FIG. 4 a schematic view of an intersection with a second exemplary embodiment according to the present invention.

For further clarification, FIG. 4 shows a further exemplary embodiment according to the present invention, in which the display device is extended against the direction of travel of the driver A1 along the main road HS. The dashed area is the area in which the warning signal of the display device AE can be perceived by the driver A1. The emission angle of the light is limited by imaginary axes running at right angles to the main road HS and side road NS.

Figure 5:
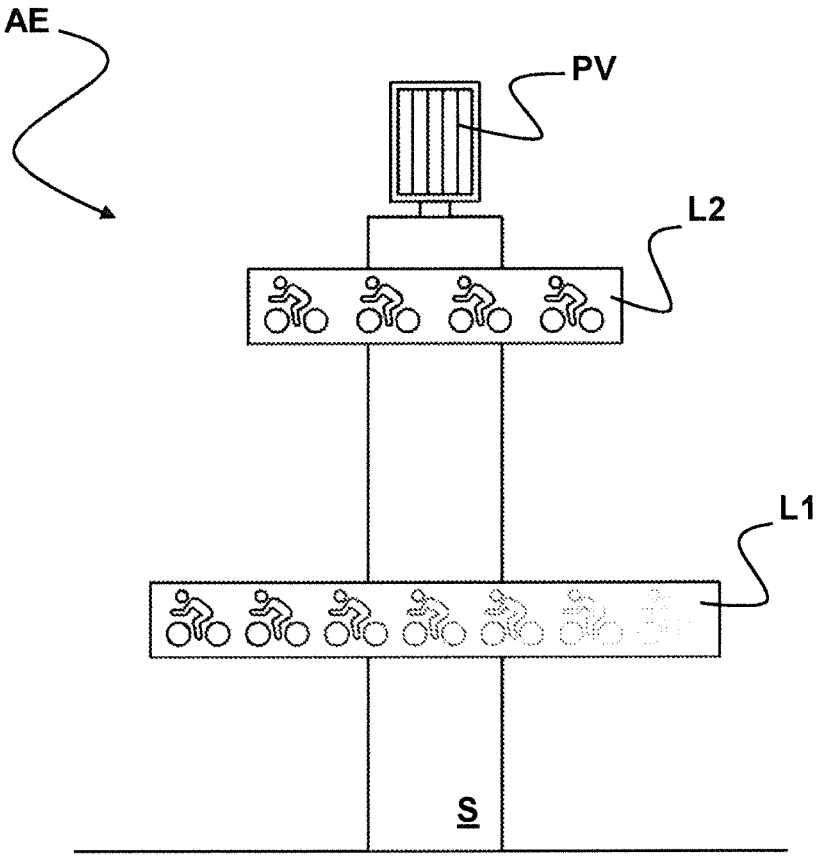
FIG. 5 a schematic side view of a particularly preferably designed display device according to the present invention.

Finally, FIG. 5 shows a schematic side view of a particularly preferably designed display unit AE according to the present invention.

The display unit AE has a column S with lights L1, L2 mounted at two different heights. The low-positioned light L1 is designed to warn car drivers, whereas the high-positioned lamp L2 is designed to warn truck drivers.

As shown for the low-positioned light L1, the at least one light L1, L2 can be designed as a light band, whereby pictograms can be used to draw attention to an approaching person, for example a cyclist.

In addition, the display device AE shown in FIG. 5 has a photovoltaic system PV, which makes it possible to operate the display device as an independent stand-alone system. The sensor for detecting the person approaching the side road NS parallel to the main road HS is not shown. Other components required for the control of the display device AE can be advantageously arranged in the column S, protected from external access.

The invention claimed is:

1. A display device for giving a visual warning to a car driver who is turning off a main road into a side road about a person who is approaching the side road parallel to the main road, comprising:

at least one sensor for sensing the person and at least one light which emits a visual warning signal when a person approaches, wherein the emission angle of the light which emits the visual warning signal is oriented so as to open into the intersection region between a first axis running transversely with respect to the course of the main road and a second axis running transversely with respect to the course of the side road and wherein the emission angle of the light is limited by the first axis and the second axis.

2. The display device according to claim 1, wherein the display device is at least partially formed as a railing accompanying the transition from the main road to the side road.

3. The display device according to claim 1, wherein the at least one light is arranged at the height of a passenger car window.

4. The display device according to claim 1, wherein the at least one light is arranged at the height of a truck window.

5. The display device according to claim 1, wherein the at least one light is designed as a display.

6. The display device according to claim 1, wherein the at least one light is convex.

7. The display device according to claim 1, wherein the display device has a lighting device which at least partially illuminates the quadrants diagonally opposite the intersection region.

8. The display device according to claim 1 further comprising a photovoltaic system supplying the display device with energy.

9. The display device according to claim 1, wherein the person sensed by the display device is a cyclist.

10. A display device for giving a visual warning to a car driver who is turning off a main road into a side road about a person who is approaching the side road parallel to the main road, comprising:

at least one sensor for sensing the person;

at least one light which emits a visual warning signal when a person approaches, wherein the emission angle of the light which emits the visual warning signal is oriented so as to open into the intersection region between a first axis running transversely with respect to the course of the main road and a second axis running transversely with respect to the course of the side road; and a lighting device which at least partially illuminates the quadrants diagonally opposite the intersection region.

11. The display device according to claim 10, wherein the display device is at least partially formed as a railing accompanying the transition from the main road to the side road.

12. The display device according to claim 10, wherein the at least one light is arranged at the height of a truck window.

13. The display device according to claim 10, wherein the at least one light is convex.

14. The display device according to claim 10 further comprising a photovoltaic system supplying the display device with energy.

15. A display device for giving a visual warning to a car driver who is turning off a main road into a side road about a person who is approaching the side road parallel to the main road, comprising:

at least one sensor for sensing the person;

at least one light which emits a visual warning signal when a person approaches, wherein the emission angle of the light which emits the visual warning signal is oriented so as to open into the intersection region between a first axis running transversely with respect to the course of the main road and a second axis running transversely with respect to the course of the side road; and a photovoltaic system supplying the display device with energy.

16. The display device according to claim 15, wherein the display device is at least partially formed as a railing accompanying the transition from the main road to the side road.

17. The display device according to claim 15, wherein the at least one light is arranged at the height of a truck window.

18. The display device according to claim 15, wherein the at least one light is convex.

19. The display device according to claim 15, wherein the display device has a lighting device which at least partially illuminates the quadrants diagonally opposite the intersection region.

* * * * *